United States Patent [19]

Katz et al.

[11] Patent Number: 4,651,643

[45] Date of Patent: Mar. 24, 1987

[54] ADAPTORS FOR USE WITH PRINTING CYLINDER MANDRELS

[76] Inventors: Sidney Katz; Robert Katz, both of 78 W. 11th St., Apt. 22, New York, N.Y. 10011

[21] Appl. No.: 701,577

[22] Filed: Feb. 14, 1985

[51] Int. Cl.[4] ..... B41F 13/10; B41F 13/20

[52] U.S. Cl. ..... 101/375; 279/1 A; 279/2 A

[58] Field of Search ..... 279/2 A, 1 A; 29/113 R; 101/375, 376; 242/72 B

[56] References Cited

U.S. PATENT DOCUMENTS

| | | | |
|---|---|---|---|
| 2,721,601 | 10/1955 | Spencer | 101/375 X |
| 3,030,120 | 4/1962 | Atherholt, Sr. | 279/1 A |
| 3,253,323 | 5/1966 | Saveressig | 101/375 X |
| 3,378,902 | 4/1968 | Hoexter | 101/375 X |
| 4,111,569 | 9/1978 | Mengel | 279/2 A X |
| 4,381,709 | 5/1983 | Katz | 101/375 |
| 4,386,566 | 6/1983 | Moss | 101/375 |

*Primary Examiner*—Clifford D. Crowder
*Attorney, Agent, or Firm*—Abelman Frayne Rezac & Schwab

[57] ABSTRACT

Adaptors for expandable mandrels of printing presses are formed as annular members which are slidable over the journals of the mandrel and lockable thereto, the adaptors each having an outwardly expandable external periphery for gripping and holding a printing cylinder of a diameter larger than that of the mandrel.

11 Claims, 4 Drawing Figures

ADAPTORS FOR USE WITH PRINTING CYLINDER MANDRELS

FIELD OF INVENTION

This invention relates to adaptors specifically for use with an expandable mandrel, such as is used in the printing industry for the support of a printing cylinder.

BACKGROUND OF THE INVENTION

Expandable mandrels for the support of printing cylinders are known from U.S. Pat. No. 4,381,709 issued May 3, 1983 to the present inventors. Such mandrels include spaced cylindrical journal members for the printing cylinder, and expandable diaphragm-like sleeves provided on the external periphery of the respective journal members, and which can be expanded radially outwardly by hydraulic actuators into gripping and supporting relationship with the interior of a printing cylinder. The respective journal members are held in fixed axially spaced relationship by an interconnecting sleeve, which is pinned to the respective journal members.

While this prior proposed arrangement is admirable in providing rigid and concentric support for a printing cylinder, it is limited in its use to the support of cylinders of only one selected internal diameter. Should it be required that a printing cylinder of a different diameter be used in the rotary press, then, it is necessary to remove the entire expandable mandrel assembly from the press and to substitute therefore a replacement mandrel assembly having a diameter appropriate to the internal diameter of the printing cylinder of larger diameter to be employed. This operation not only is time consuming with the consequential expense of down-time of the press, but also requires that a range of mandrel assemblies appropriate to the expected range of printing cylinder diameters be available at the site of the printing press, with the consequential expense of providing a multiplicity of mandrels of different diameters, and, the expense entailed in the required storage of those mandrels that are not in use.

This problem is overcome to the greatest possible extent by the provision of annular hydraulically actuated journals having expandable members at their inner and outer peripheries, and which can be hydraulically locked to a central shaft, as is taught by the present applicants in U.S. Ser. No. 593,952 filed Mar. 27, 1984, now U.S. Pat. No. 4,624,184. However, this concept cannot be employed where expandable mandrels are the only ones available to the printer, in that such mandrels are devoid of a central shaft.

SUMMARY OF THE INVENTION

This invention has for its object to provide means whereby expandable mandrels of fixed diameter, such as are disclosed in U.S. Pat. No. 4,381,709, can be adapted to any selected larger diameter, without the need for disassembling such mandrels and replacing the journal members with journal members of a larger diameter.

In order to enable the required change in mandrel diameter, the present invention provides adaptors for such mandrels, said adaptors each being comprised of an annular member having a radially inner cylindrical surface for engagement by an expandable member of a conventional expandable mandrel, and, a radially outer cylindrical surface incorporating an expandable diaphragm-like sleeve.

The adaptors either incorporate hydraulic actuators, or, the respective adaptors are formed with dual diaphragm-like sleeves, one at each of their inner and outer peripheries and which are interconnected by passages within the adaptor. Expansion of the central expandable mandrel will cause hydraulic fluid contained within the adaptors to be transferred radially outwardly through passageways in the adaptors to pressure the diaphragm-like sleeve at the radially outer diameter thereof.

The present invention also provides means whereby the annular adaptor members can be securely locked into a cylinder prior to mounting of the assembly on a central mandrel, the ends of the inner surface of the printing cylinder being formed arcuate for this purpose.

DESCRIPTION OF THE DRAWINGS

The invention will now be described with reference to the accompanying drawings, which are illustrative of preferred embodiments of the invention, and, in which:

In FIG. 1, only one end of the expandable mandrel is illustrated, the opposite end of the mandrel being identical in all respects. The mandrel includes journal members 14, which are held in spaced axial alignment by a central sleeve 15 pinned to the respective journal members.

Figure 1:
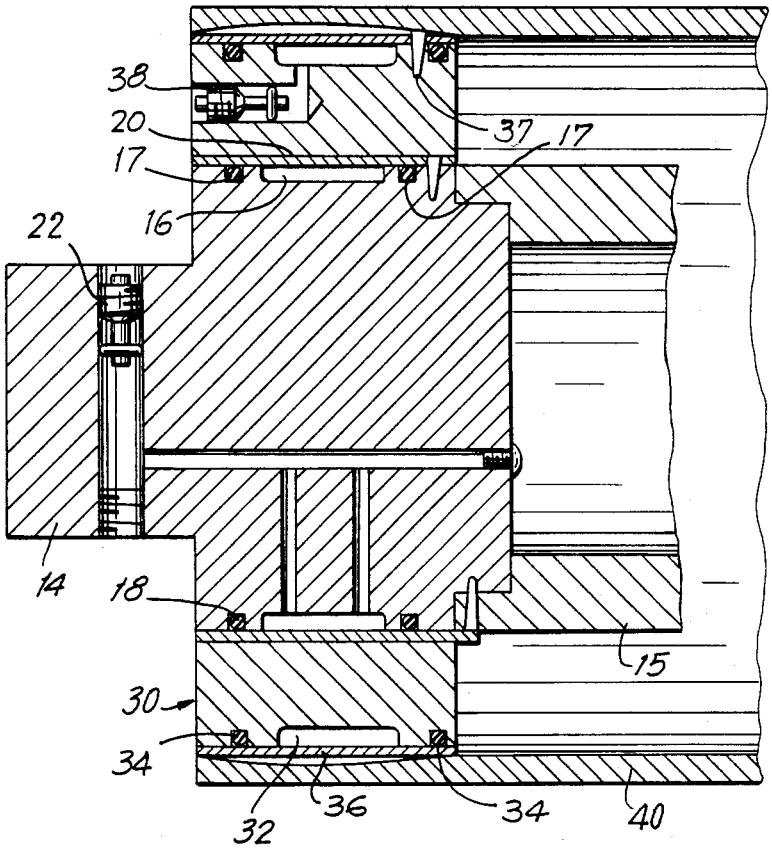
FIG. 1 shows an adaptor according to the present invention in cross-section, and, in association with one end of an expandable mandrel of the type of disclosed in U.S. Pat. No. 4,381,709.

Each journal member 14 is peripherally centrally grooved as at 16, and includes grooves 17 at opposite sides of the central groove 16 in which are received O-rings 18 of an elastomeric material.

Positioned over the outer periphery of each of the journal members 14 is a flexible diaphragm-like sleeve 20 formed from steel or other suitable material, and which is conjunction with the associated journal member and the O-rings 18 provides a closed pressurizable chamber.

A suitable hydraulic actuator 22 and connecting conduits is provided in each journal member, whereby the sleeve 20 can be expanded radially outwardly into gripping relationship with the internal periphery of another tubular member, such as a printing cylinder, to hold and position that tubular member in concentric relationship with the longitudinal axis of the mandrel.

Proceeding from this prior disclosed construction, the present invention provides means whereby printing cylinders of any selected internal diameter larger than the external diameter of the sleeves 20 can be mounted on the mandrel, without the necessity for replacing that mandrel with a mandrel of appropriate larger diameter corresponding with the internal diameter of the selected larger diameter printing cylinder.

Accordingly, the present invention provides an adaptor 30 to be mounted on each journal member 14, each adaptor 30 being in the form of an annulus of a rigid, inflexible, and dimensionally stable material, such as aluminum, having an internal diameter only slightly greater than the external diameter of the sleeves 20 when in their relaxed condition prior to expansion.

In this manner, an adaptor can be slid over the journal members at each end of the mandrel, and secured thereto in the same manner as that employed to mount and secure a printing cylinder. The adaptors are locked to the mandrel by operation of the respective hydraulic actuators 22 associated with the respective journal members 14.

Each adaptor is provided with a central channel 32 having its outer periphery flanked by O-ring receiving grooves 34, and with an outer diaphragm-like sleeve 36 similar to the sleeves 20 of the respective journal members 14, which hermetically seals the central channel and is pinned to the adaptor 30 by pins 37.

The channels 32 of each adaptor are in communication with a hydraulic actuator 38 through appropriate conduits formed in the adaptor, an include an appropriate closeable air bleed device (not shown) permitting the purging of air from the channels during filling of the actuators and channels with hydraulic fluid.

In the same manner as the hydraulic actuators 22, the hydraulic actuators 38 are employed to expand the sleeves 36 of the respective adaptors radially outwardly into holding and gripping engagement with the inner periphery of a printing cylinder 40, thus to support and hold the printing cylinder 40 concentric with the longitudinal axis of the mandrel.

Thus, by selecting an adaptor of appropriate external diameter, any one of a plurality of printing cylinders of different internal diameters can be mounted on a single standard mandrel without the necessity of replacing the mandrel itself.

Alternatively, the respective adaptors 30 can be inserted into the ends of an appropriate printing cylinder 40, and can be locked into the cylinder by appropriate actuation of the hydraulic actuators 38 of the respective adaptors prior to the mounting the printing cylinder 40 on the mandrel.

Figure 2:
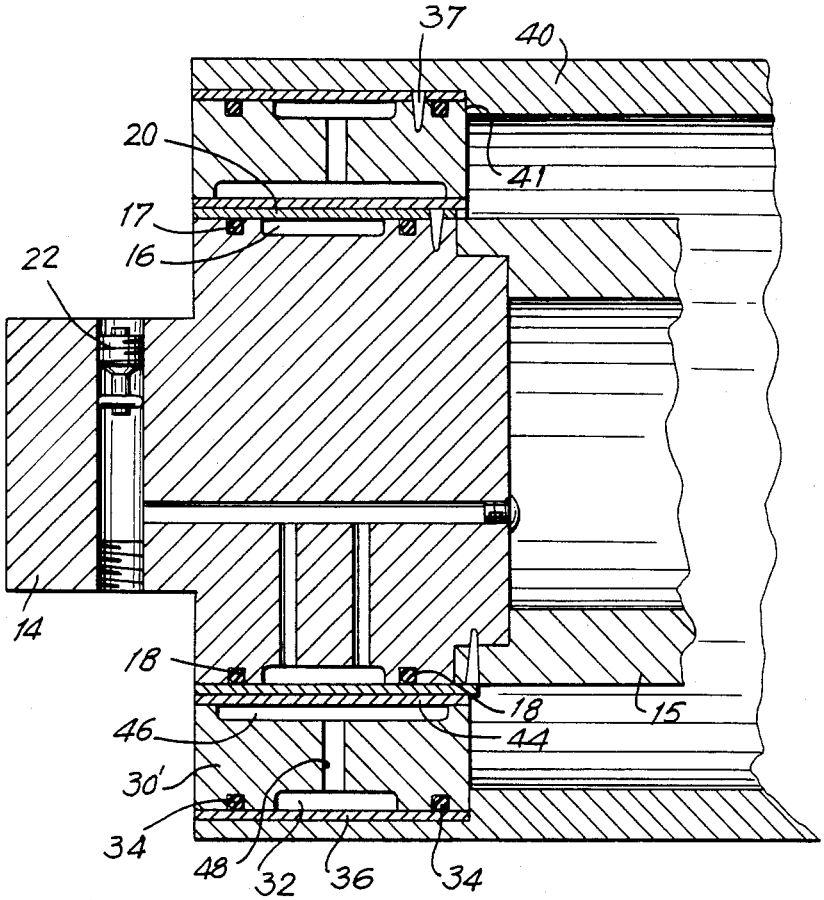
FIG. 2 is a cross-section through an alternative form of adaptor according to the present invention, shown in cross-section, and, in association with one end of a mandrel according to U.S. Pat. No. 4,381,709; and, FIGS. 3 and 4 are fragmentary diagramatic views of alternative embodiments of the adaptors and printing cylinders.

If this procedure is employed, preferably the ends of the printing cylinder are internally stepped as indicated at 41 in FIG. 2, in order to prevent the respective adaptors from moving beyond their intended positioning within the interior of the printing cylinder.

Additionally, and as is shown in FIG. 1, the ends of the printing cylinder can be formed internally with surfaces that are arcuate in the longitudinal direction of the cylinder for the ends of the cylinder to be slightly internally barrelled. In this manner, not only does the contour of ends of the cylinder conform to the contour of the respective sleeves 36 when in their expanded pressurized condition, but also, the adaptors are locked even more securely into the ends of the cylinders and in this manner further preclude the possibility of axial movement of the adaptors relative to the printing cylinder during a printing operation.

Figure 3:
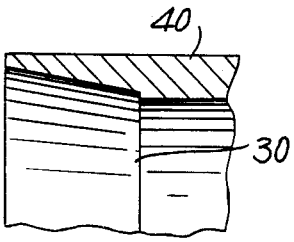
Figure 4:
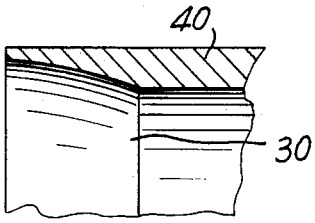

Alternatively, the ends of the cylinder and the outer periphery of the adaptor can be formed slightly outwardly conical to facilitate assembly and disassembly of the assembly, either as axially straight surfaces as shown in FIG. 3, or as outwardly diverging barrelled surfaces as shown in FIG. 4.

Referring now to FIG. 2 of the drawings, an alternative form of the adaptor of the present invention is shown in assembled relationship with one end of a mandrel and a printing cylinder of larger diameter than that of the mandrel. In FIG. 2 the same reference numerals are used to identify those members which have already been described with reference to FIG. 1.

In FIG. 2, the adaptor 30[1] is of similar construction to that described with reference to FIG. 1, with the major exception that the hydraulic actuator 38 is omitted in its entirety. Instead, an additional diaphragm-like sleeve 44 is provided at the inner periphery of the adaptor.

The inner sleeve 44 overlies and hermetically seals a channel 46 provided in the inner periphery of the adaptor, and which is connected with the outer peripheral channel 32 by a radial passage 48.

Any convenient means (not shown) is provided for charging the respective channels 32, 46 and the radial passage 48 with hydraulic fluid and for purging any air therefrom, such that the cavities of the adaptor are completely charged with hydraulic fluid at atmospheric pressure, or at a pressure only slightly in excess of atmospheric pressure.

Conveniently, the O-ring receiving grooves and the O-rings are omitted at the inner periphery of the adaptor, and the sleeve 44 is soldered, brazed, or otherwised hermetically sealed and secured to the body of the adaptor.

By this modification, extreme simplification of the structure of the adaptor is obtained, with a concomitant saving in the manufacturing cost thereof.

In use, and as is described above with respect to the embodiment of FIG. 1, the adaptors and the printing cylinder are assembled over the mandrel, and, the hydraulic actuators 22 of the respective journal members are operated to expand the sleeves 20 associated with the mandrels radially outwardly.

In so expanding, the sleeves 20 also expand the sleeves 44 at the inner peripheries of the adaptors in a radially outward direction, and, in so doing, apply a compressive force to the hydraulic fluid contained within the adaptors. This acts to displace the hydraulic fluid through the passage 48 and into the outer channel 32, at which location the hydraulic fluid acts to expand the sleeves 36 radially outwardly into locking engagement with the inner periphery of the cylinder 40.

If desired, the entire outer surface of the adaptors of the FIGS. 1 and 2 embodiments, or, the enter surfaces of the diaphragm-like sleeves, may be coated with a thin film of a wear-resistant, resilient but relatively incompressible material to provide frictional restraint on the adaptor as it is positioned in assembly with the mandrel and the associated printing cylinder, the frictional restraint being sufficient to minimize unintentional displacement of the adaptor relative to those elements prior to the actuation of the mandrel expander, and of the adaptor expander in the event that such is provided.

As will be appreciated, while hydraulic actuators integral with and forming part of the adaptors have been described, other pressurization means equally well can be employed, such as conventional Zerk fitting for cooperation with a grease gun or other source of hydraulic fluid under pressure.

We claim:

1. An adaptor, specifically for use with an expandable mandrel of the type having at least one flexible and resilient diaphragm-like sleeve on its outer periphery, and means for expanding said sleeve radially outwardly into gripping relationship with the inner periphery of a printing cylinder, said adaptor comprising:

an rigid, inflexible, and dimensionally stable annular member;

a circumferentially extending channel in the outer periphery of said annular member;

at least one flexible and resilient diaphragm-like member on the outer periphery of said adaptor, said diaphragm-like member extending across said channel and hermetically sealing said channel; and, means for expanding said diaphragm-like sleeve of said adaptor radially outwardly;

whereby said adaptor can be secured at its inner periphery to said mandrel by expansion of the diaphragm-like sleeve of said mandrel, and in turn can secure and support a printing cylinder of appropriate internal diameter by expansion of the diaphragm-like sleeve of aid adaptor.

2. The adaptor of claim 1, further including a hydraulic actuator incorporated into said annular member, and operative on actuation to expand said diaphragm-like sleeve of said adaptor radially outwardly into locking engagement with the inner periphery of a printing cylinder.

3. The adaptor of claim 1, further including:

a circumferentially extending channel in the inner periphery of said annular member;

at least one flexible and resilient diaphragm-like member on the inner periphery of said adaptor, said diaphragm-like member extending across said channel and hermetically sealing said channel; and hydraulic fluid filling spaces within said adaptor enclosed by said inner and outer sleeves of said adaptor, said spaces being interconnected internally of said adaptor by at least one passage within said adaptor;

whereby, radially outward expansion of said inner diaphragm-like sleeve of said adaptor will produce radially outward expansion of said outer diaphragm-like sleeve of said adaptor.

4. The adaptor of claim 1, further including a coating of a wear-resistant resilient but relatively incompressible plastics material on at least said inner and outer peripheries of said adaptor and providing limited frictional engagement with said mandrel and said printing cylinder.

5. In combination:

an expandable mandrel having at least one flexible and resilient diaphragm-like sleeve on its outer periphery and means for expanding said sleeve radially outwardly;

a rigid, inflexible, and dimensionally stable annular member mounted on said mandrel sleeve by expanding said mandrel sleeve radially outwardly, said annular member having an internal diameter only slightly in excess of the diameter of said sleeve of said mandrel, said annular member having a circumferentially extending channel in the outer periphery of said annular member, said channel being hermetically sealed by a flexible and resilient diaphragm-like sleeve extending across said channel on the outer periphery of said adaptor, and means for expanding said diaphragm-like sleeve in a radially outward direction; and a printing cylinder mounted on said annular member by expanding the sleeve of said annular member radially outwardly, said printing cylinder having ends configured for the reception of said annular member.

6. The combination of claim 5, in which said annular member further includes hydraulic pump means incorporated into said annular member, and which is operative on actuation to expand said diaphragm-like sleeve of said annular member radially outwardly into locking engagement with the inner periphery of said printing cylinder.

7. The combination of claim 5, in which said annular member further includes at least one flexible and resilient diaphragm-like sleeve on the inner periphery of said annular member, and hydraulic fluid filling spaces within said annular member enclosed by said diaphragm-like sleeves at the radially inner and outer peripheries thereof, said spaces being interconnected internally of said annular member by at least one passage within said annular member.

8. The combination of claim 5, further including a coating of wear-resistant resilient and incompressible plastics material on at least one of the inner and outer peripheral surfaces of said annular member.

9. The combination of claim 5, further including said printing cylinder having concave internal end surfaces for engagement by said annular member.

10. The combination of claim 5, further including said printing cylinder having stepped internal end surfaces for engagement by said annular member.

11. The combination of claim 5, in which the inner surface of the ends of said cylinder are slightly axially divergent, and said annular member is formed at its outer surface to be correspondingly axially divergent.

* * * * *